US009625934B2

(12) United States Patent
Ryabchenkov et al.

(10) Patent No.: US 9,625,934 B2
(45) Date of Patent: Apr. 18, 2017

(54) VOLTAGE REGULATOR WITH IMPROVED LOAD REGULATION

(71) Applicants: Sergey Sergeevich Ryabchenkov, Zelenograd (RU); Ivan Victorovich Kochkin, Zelenograd (RU)

(72) Inventors: Sergey Sergeevich Ryabchenkov, Zelenograd (RU); Ivan Victorovich Kochkin, Zelenograd (RU)

(73) Assignee: NXP USA, Inc., Austin, TX (US)

( * ) Notice: Subject to any disclaimer, the term of this patent is extended or adjusted under 35 U.S.C. 154(b) by 7 days.

(21) Appl. No.: 14/765,840

(22) PCT Filed: Feb. 14, 2013

(86) PCT No.: PCT/RU2013/000118

§ 371 (c)(1),
(2) Date: Aug. 5, 2015

(87) PCT Pub. No.: WO2014/126496

PCT Pub. Date: Aug. 21, 2014

(65) Prior Publication Data

US 2015/0370280 A1 Dec. 24, 2015

(51) Int. Cl.
*G05F 1/575* (2006.01)
*G05F 3/26* (2006.01)

(52) U.S. Cl.
CPC ..... *G05F 3/26* (2013.01); *G05F 1/575* (2013.01)

(58) Field of Classification Search
CPC ..... G05F 3/26; G05F 1/575
(Continued)

(56) References Cited

U.S. PATENT DOCUMENTS 6,366,154 B2 * 4/2002 Pulvirenti ..... G11C 17/18 327/525
6,933,772 B1 8/2005 Banerjee et al.
(Continued)

FOREIGN PATENT DOCUMENTS

| | | |
|---|---|---|
| JP | 2002032133 | 1/2002 |
| JP | 2002091580 | 3/2002 |
| WO | 2005022283 | 3/2005 |

OTHER PUBLICATIONS

Received search report from STIC EIC 2800 searcher Benjamin Martin on Aug. 26, 2016.*
(Continued)

*Primary Examiner* — Jue Zhang
*Assistant Examiner* — Htet Z Kyaw

(57) ABSTRACT

A voltage regulator comprises a ground node, a pick-off node, a regulator branch, a load branch, and a current mirror the regulator branch and the load branch are connected in parallel between the pick-off node and the ground node; the load branch comprises one or more resistive connecting lines that are connectable in series with the load to generate a load current through the load branch; the regulator branch comprises a bias node, a resistive element, and a tap node; the bias node is arranged to provide a regulated bias voltage; the resistive element is connected between the bias node and the pick-off node; and the tap node is connected between the bias node and the resistive element. The current mirror is connected to the tap node and arranged to draw a mirror current from the tap node; the mirror current having a component that is proportional to the load current.

18 Claims, 2 Drawing Sheets

(58) Field of Classification Search
USPC ..... 323/315, 353, 298, 367, 369
See application file for complete search history.

(56) References Cited

U.S. PATENT DOCUMENTS

| | | | | |
|---|---|---|---|---|
| 7,893,671 | B2 | 2/2011 | Sahni et al. | |
| 7,990,126 | B1 | 8/2011 | Zhang et al. | |
| 2005/0248391 | A1* | 11/2005 | Itoh | G05F 1/575 327/540 |
| 2011/0068854 | A1* | 3/2011 | Engl | G05F 3/30 327/512 |

OTHER PUBLICATIONS

International Search Report and Written Opinion correlating to PCT/RU2013/000118 issued on Jan. 23, 2014.

* cited by examiner

VOLTAGE REGULATOR WITH IMPROVED LOAD REGULATION

FIELD OF THE INVENTION

This invention relates to a voltage regulator.

BACKGROUND OF THE INVENTION

A voltage regulator is a device for regulating a voltage applied across a load so as to make the applied voltage insensitive against changes in the current drawn by the load. An ideal voltage regulator delivers a voltage that does not depend on the resistance of the load.

SUMMARY OF THE INVENTION

The present invention provides a voltage regulator as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION OF THE PREFERRED EMBODIMENTS

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Figure 1:
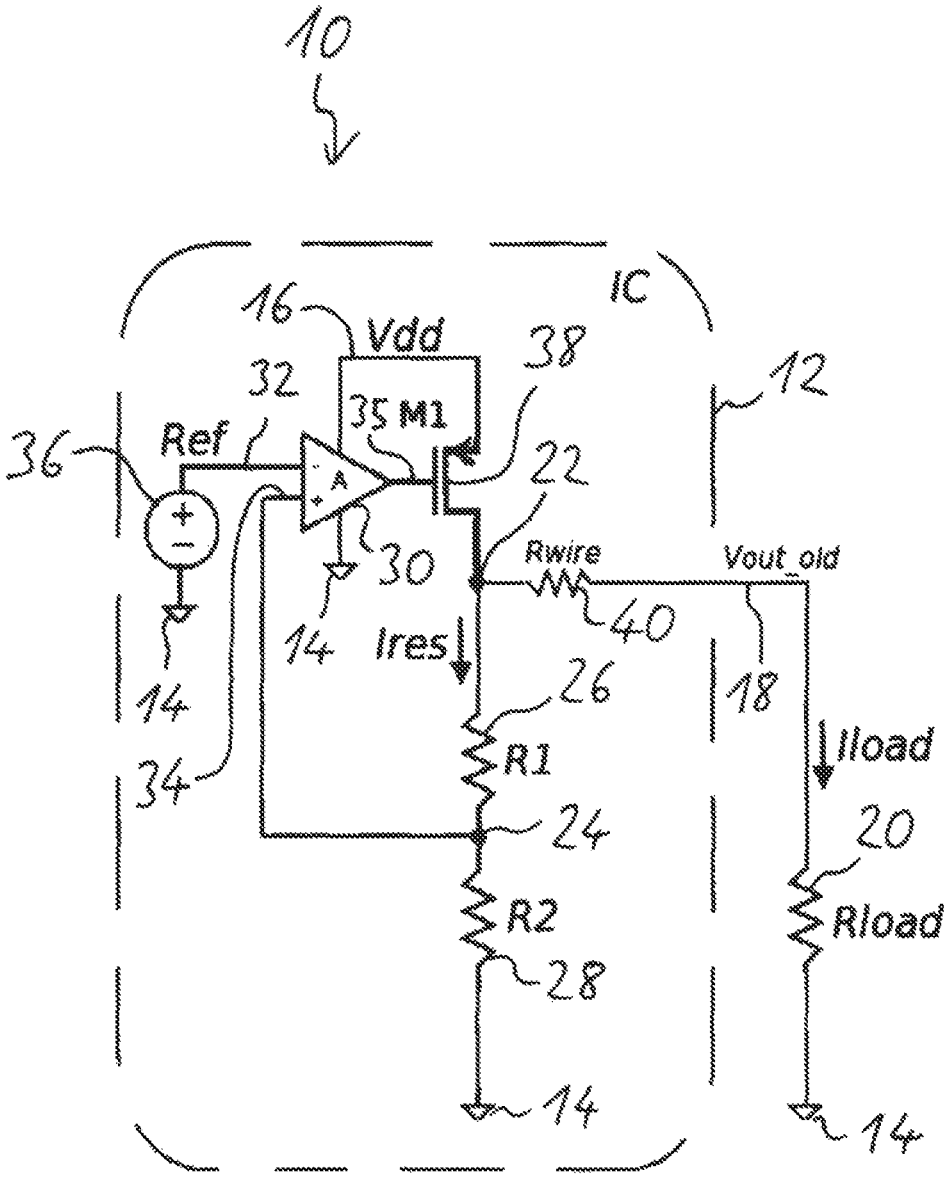
Fig. 1 (Prior Art)
FIG. 1 schematically shows an example of an embodiment of a voltage regulator.

FIG. 1 schematically shows an example of a voltage regulator 10. The voltage regulator 10 may be implemented as an integrated circuit (IC) 12. The regulator 10 may comprise a ground node 14 and a supply node 16. The regulator 10 may be powered by applying a ground voltage at the ground node 14 and a different, e.g., higher supply voltage Vdd at the supply node 16. The regulator 10 may further comprise an output node 18 for delivering an output voltage Vout_old. A load 20 may be connected between the output node 18 and the ground node 14. The voltage between the output node 18 and the ground node 14 may generate a load current Iload in the load 20.

The regulator 10 may comprise a pick-off node 22 for providing a regulated voltage (pick-off voltage). In the shown example, the pick-off voltage at the pick-off node 22 is regulated by means of a feedback loop 22, 26, 24, 34, 30, 35, 38, 22. It is pointed out that this feedback loop is only an example and that a variety of other negative feedback mechanisms may be employed. The shown example of a feedback loop notably comprises an operational amplifier 30 and transistor 38. The transistor 38 may be connected between the supply node 16 and the pick-off node 22. The transistor 38 may have a control terminal connected to an output 35 of the operational amplifier 30. In the example shown, the transistor 38 is a PMOS field effect transistor with a source terminal connected to the supply node 16, a drain connected to the pick-off node 22, and a gate acting as the control terminal. The operational amplifier 30 may have a differential input 32, 34 that comprises a first input 32 (reference input) and a second input 34 (feedback input). The reference input 32 may be connected to a voltage source 36 so as to apply a reference voltage Ref to the reference input 32. The operational amplifier 34 may be arranged to deliver an amplifier output voltage at the output 35. The amplifier output voltage may be proportional to the voltage difference applied at the differential input 32, 34. A bias node 24, connected between, e.g., the ground node 14 and the pick-off node 22, may be connected to the feedback input 34. The conductivity of the transistor 38 may thus be adapted in dependence on the difference between the voltage at the bias node 24 (bias voltage) and the reference voltage Ref, resulting in a negative feedback. Figuratively speaking, the operational amplifier 30, by controlling the transistor 38, attempts to minimize the differential voltage at the differential inputs 32, 34. As a result, the voltage at the bias node 24 may settle at the reference voltage Ref. In other words, the operational amplifier may pull the voltage at the bias node 24 to the reference voltage Ref.

The bias node 24 may be part of a voltage divider connected between the pick-off node 22 and the ground node 14. In the example shown, the voltage divider comprises a resistive element 26 (second resistive element), the bias node 24, and a resistive element 28 (third resistive element). The second resistive element 26 may be connected between the pick-off node 22 and the bias node 24. The third resistive element 28 may be connected between the bias node 24 and the ground node 14.

The voltage regulator 10 may thus comprise a regulator branch 26, 24, 28 and a load branch 18, 20 which are connected in parallel between the pick-off node 22 and the ground node 14. The regulator branch 26, 24, 28 in conjunction with the feedback network 30, 38 thus provides regulated voltage levels at both the bias node 24 and the pick-off node 22. A stationary load current Iload and a stationary residual current Ires may thus be generated in the load branch 18, 20 and in the regulator branch 26, 24, 28, respectively.

In a simplified picture, the load 20 may be connected between, e.g., the ground node 14 and the pick-off node 22 through one or more connecting lines 40 that have a negligible resistance. In this simplified picture, the load 20 may thus experience a voltage that is identical to the voltage at the pick-off node 22 (pick-off voltage). In other words, the output voltage Vout_old seen by the load 20 is identical to the pick-off voltage, as there is no voltage drop in the one or more connecting lines 40. The pick-off voltage may be related to the reference voltage Ref as follows: Vpick-off=(R1+R2)/R2 *Ref. The residual current Ires in the regulator branch may be expressed as Ires=Ref/R2. The load current Iload in the load branch 18, 20 may be expressed as Iload=Vpickoff/Rload. R1, R2, and Rload are the resistances of the second resistor 26, the third resistor 28, and the load 20, respectively. In a typical scenario, each of the resistances R1 and R2 is at least a magnitude greater than the resistance Rload of the load 20. Accordingly, the residual current Ires in the regulator branch 26, 24, 28 may be at least a magnitude smaller than the load current Iload.

In a more realistic picture, however, the connecting wires in the load branch 18, 20 between the pick-off node 22 and the ground node 14 are not negligible and may be characterized by a positive resistance Rwire. Rwire may be the total resistance of the one or more connecting lines 40, e.g., wires, that may be connected between the pick-off node 22 and the load 20 and also between the load 20 and the ground node 14. The resulting voltage experienced by the load 20 is therefore Vout_old=Rload/(Rwire+Rload)*Vpick-off. The load voltage Vout_old is seen to depend on the resistance Rload of the load 20. This effect is explained by the fact that the resistive connecting lines 40 are located outside the feedback loop 24, 30, 22, 26. Such dependence of the load voltage Vout_old on the resistance of the load may be undesired.

Figure 2:
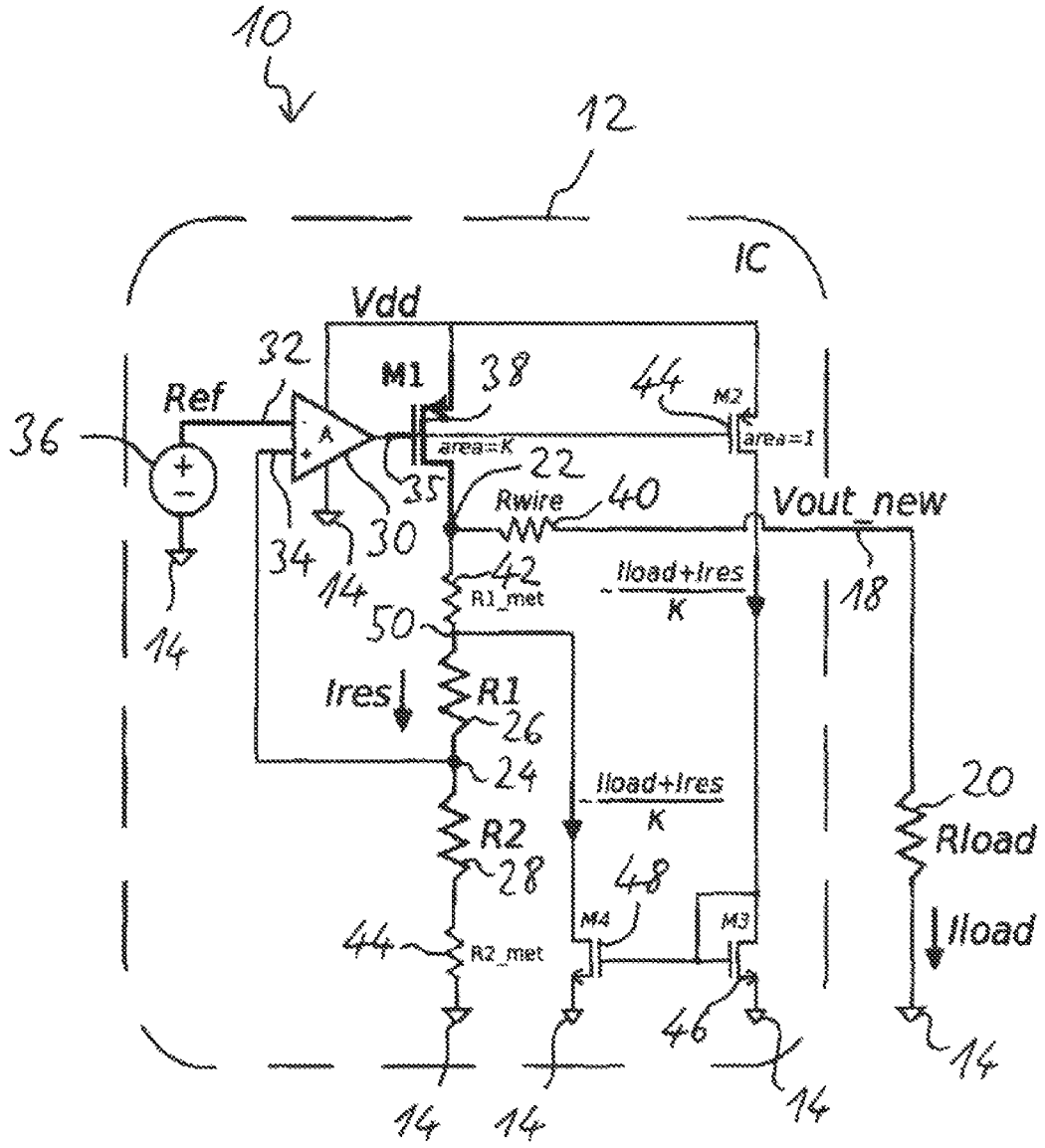
FIG. 2 schematically shows an example of another embodiment of a voltage regulator.

Referring now to FIG. 2, an example of a modified version of the voltage regulator 10 is described. The regulator 10 comprises additional circuitry designed to compensate for the voltage drop across the one or more connecting lines 40 described above in reference to FIG. 1. As a result, the voltage experienced by the load 20, indicated as Vout_new in FIG. 2, may depend less markedly on the load current Iload. The idea may be seen in raising the voltage at the pick-off node 22 in proportion to the load current Iload, thereby compensating at least partially the voltage drop across the one or more connecting lines 40. In the shown example, this may be achieved by means of a voltage raising element connected between the bias node 24 and the pick-off node 22, wherein the voltage raising element is arranged to increase the voltage between the bias node 24 and the pick-off node 22 when the load current Iload increases and to decrease the voltage between the bias node 24 and the pick-off node 22 when the load current Iload decreases.

In the example shown, the voltage raising element may be provided in the form of a resistive element 42 connected between the pick-off node 22 and a tap node 50. The tap node 50 may be located on the regulator branch between the resistive element 42 and the bias node 24. In this particular example, the regulator branch, i.e., the branch connecting the pick-off node 22 to the ground node 14 via the bias node 24, may comprise the following elements connected in series in this order: The resistive element 42 (first resistive element), the tap node 50, the second resistive element 26, the bias node 24, the third resistive element 28, and a fourth resistive element 44. The resistive elements 42, 26, 28, and 44 may have resistances R1_met, R1, R2, and R2_met, respectively. As mentioned above, the resistances R1 and R2 may be large in comparison to the resistance Rload of the load 20 in order to minimize a power loss involved with the residual current Ires.

The tap node 50 may be connected to a current mirror for drawing a tap current Itap from the tap node 50 to increase the voltage across the first resistive element 42 by an increment of R1_met*Itap. The current mirror may be coupled to the rest of the circuit in such a way that an increase of the load current Iload is accompanied by a corresponding increase of the tap current Itap. The tap current may, for instance, be proportional to the load current Iload. Alternatively, the tap current may, for example, be the sum of an offset component which does not correlate with the load current Iload and a linear component that is proportional to the load current Iload.

In the shown example, the current mirror comprises a first current mirror 38, 44 and a second current mirror 46, 48. The first current mirror may comprise the first transistor 38 and a second transistor 44 while the second current mirror may comprise a third transistor 46 and a fourth transistor 48. The first current mirror 38, 44 may be arranged to generate a first mirror current through the second transistor 44 that is proportional to the current through the first transistor 38. The second current mirror 46, 48 may generate the tap current in proportion to the first mirror current. The tap current may also be referred to as the second mirror current. The mirror ratio of the current mirror 38, 44, 46, 48 may be significantly smaller than 1 so as to minimize a power loss associated with the first and second mirror currents. For example, the tap current may be a fraction 1/K of the current through the first transistor 38. In the shown example, the first current mirror 38, 44 has a mirror ratio of 1/K. In other words, the first mirror current, that is, the current the second transistor 44 and the third transistor 46, may be 1/K*(Iload+Ires), noting that the current through the first transistor 48 is the sum of the load current Iload and the residual current Ires, and considering that the tap current Itap may be small compared to the residual current Ires if the constant K is chosen sufficiently large. For example, K may be chosen greater than five or, e.g., greater than fifty. The mirror ratio 1/K may be substantially identical to the area ratio of the second transistor 44 and the first transistor 48. More specifically, the first transistor 38 may have a cross-sectional area which is K times larger than the cross-sectional area of the second transistor 44. The mirror ratio of the second current mirror 46, 48 may be one, for example. However, other ratios are possible. The load regulation may be trimmed by selecting suitable mirror ratios.

The first resistive element 42 may thus raise the pick-off voltage 22 by a value of approximately R1_met*Iload/K compared to a situation in which the load current is zero. On the other hand, the one or more connecting wires may cause a voltage loss of magnitude Rwire*Iload. This loss may be canceled by choosing the constant K and the resistance R1_met such that R1_met/K=Rwire. In order to ensure that this compensation is valid at different temperatures, the resistive element 42 may be made of the same material as the one or more connecting lines 40.

It is noted that the first resistive element 42 is, in this example, traversed not only by the tap current Itap but also by the residual current Ires and that the total voltage across the first resistive element is therefore R1_met*(Ires+Itap). The component Itap*R1_met may be desired to compensate the voltage Rwire*Iload in the load branch as discussed above. The component R1_met*Ires may, however, be considered as side effect of the introduction of the first resistive element 42, and it may be problematic insofar as the resistance R1_met may have a different temperature characteristic compared to the resistances R1 and R2 of the voltage divider. In the shown example, the fourth resistive element 44 has been introduced to ensure that the ratio (R1_met+R1)/(R2+R2_met) has a temperature characteristic that is not adversely affected by the introduction of the first resistive element 42. More specifically, the resistances R1_met and R2_met may be chosen such that (R1_met+R1)/(R2+R2_met)=R 1/R2, which is equivalent to R1/R1_met=R1/R2.

There may be a good compensation in a full temperature range if the material of the one or more connecting lines and the resistive elements 42 and 44 is identical, e.g., aluminum. If the materials are different, however, compensation may be achieved at one temperature. Other contributors of load regulations may be trimmed too, for example, in case of a small amplifier gain. It may also be possible to implement a negative load regulation term in order to compensate some external contributors, such as a resistance of a printed circuit board (PCB) between the IC and the load 20. The load regulation may be trimmed by changing a ratio of the current mirrors 38 and 44 or 46 and 48.

In one example, the following numerical values may apply: Ref=1 V, R1/R2=4, resulting in Vout=5 V, Iload_max=0.5 A. The one or more connecting lines, e.g. a wire, may, for example, have a length of 2 mm; Rwire=0.1 Ohm at a temperature T=25° C. In the scheme of FIG. 1, there thus be a non-compensated voltage drop due to Rwire and Iload of 0.5 A*0.1 Ohm=50 mV. In the improved scheme (see FIG. 2) with, e.g., R1=0.4 MOhm, R2=0.1 MOhm, K=200, R1_met=0.1 Ohm*200=20 Ohm, R2_met=5 Ohm, the load dependence may be compensated.

In the foregoing specification, the invention has been described with reference to specific examples of embodiments of the invention. It will, however, be evident that various modifications and changes may be made therein without departing from the broader spirit and scope of the invention as set forth in the appended claims. For example, the resistive element 26 may be omitted if a regulated voltage at the bias node 24 is provided in some other manner.

Although specific conductivity types or polarity of potentials have been described in the examples, it will be appreciated that conductivity types and polarities of potentials may be reversed.

Also for example, in one embodiment, the illustrated examples may be implemented as circuitry located on a single integrated circuit or within a same device. For example, the voltage source 36 may be located within the IC 12. Alternatively, the examples may be implemented as any number of separate integrated circuits or separate devices interconnected with each other in a suitable manner. For example, the voltage source 36 may be external to the IC 12.

Also for example, the examples, or portions thereof, may implemented as soft or code representations of physical circuitry or of logical representations convertible into physical circuitry, such as in a hardware description language of any appropriate type.

However, other modifications, variations and alternatives are also possible. The specifications and drawings are, accordingly, to be regarded in an illustrative rather than in a restrictive sense.

The expression "equal" or "identical" means equal or identical for the purpose in question. For instance, two numerical values may be considered equal if a difference between them is negligibly small for the purpose in question.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention clamed is:

1. A voltage regulator for applying a regulated voltage across a load, wherein the voltage regulator comprises a ground node, a pick-off node, a regulator branch, a load branch, and a current mirror;

the ground node is arranged to provide a ground voltage;

the pick-off node is arranged to provide a pick-off voltage;

the regulator branch and the load branch are connected in parallel between the pick-off node and the ground node;

the load branch comprises one or more resistive connecting lines that are connected or connectable in series with the load to generate a load current through the load branch;

the regulator branch comprises a bias node, a first resistive element, a tap node, a voltage divider comprising second and third resistive elements, and a fourth resistive element, the voltage divider connected between the tap node and the ground, wherein the voltage divider comprises the bias node, the bias node is arranged to provide a regulated bias voltage, the first resistive element is connected between the bias node and the pick-off node, the second resistive element is connected between the voltage divider and the ground node, and the tap node is connected between the bias node and the first resistive element the first, second, third, and fourth resistive elements have resistances R1_met, R1, R2, and R2_met, respectively, and the ratio R1_met/R2_met is equal to the ratio R1/R2;

wherein the current mirror is connected to the tap node and arranged to draw a tap current from the tap node; the tap current having a component that is proportional to the load current so that the pick-off voltage increases when the load current increases and decreases when the load current decreases.

2. The voltage regulator of claim 1, wherein the tap current is equal to a fraction 1/K of the load current, wherein K is a constant greater than five.

3. The voltage regulator of claim 2, wherein the first resistive element has a resistance R1_met and the one or more connecting lines together have a resistance Rwire, and wherein R1_met divided by K is approximately equal to Rwire.

4. The voltage regulator of claim 1, wherein the first resistive element and the one or more connecting lines are made of the same material.

5. The voltage regulator of claim 1, wherein the first resistive element and the one or more connecting lines are made of a metal.

6. The voltage regulator of claim 1, comprising a feedback network for regulating the bias voltage to a reference voltage.

7. The voltage regulator of claim 6, wherein the feedback network comprises an operational amplifier and a transistor; the operational amplifier has a reference input, a feedback input and an amplifier output; the transistor is connected between a supply node and the pick-off node and has a control terminal connected to the amplifier output.

8. The voltage regulator of claim 7, wherein the current mirror is a second current mirror, the tap current is a second mirror current, the transistor is a first transistor, and the voltage regulator comprises a second transistor;

wherein the first transistor and the second transistor are connected to form a first current mirror for generating a first mirror current that is proportional to the current through the first transistor; and the second current mirror is arranged to mirror the first mirror current, thus generating the tap current.

9. The voltage regulator of claim 1, wherein the current mirror is a second current mirror and the voltage regulator comprises a first current mirror;

the first current mirror is arranged to generate a first mirror current that has a component proportional to the load current;

the second current mirror is arranged to mirror the first mirror current, thus generating the second mirror current.

10. The voltage regulator of claim 1, wherein the first resistive element, the fourth resistive element, and the one or more connecting lines are made of the same material.

11. The voltage regulator of claim 1, wherein the second and third resistive elements are made of the same material.

12. A method for applying a regulated voltage-across a load, comprising:

providing a ground voltage and a pick-off voltage to a regulator branch and a load branch connected in parallel between the pick-off voltage and the ground voltage;

generating a load current through a load branch, wherein the load branch comprises one or more resistive connecting lines that are connected or connectable in series with the load;

providing a regulated bias voltage through a bias node that is part of the regulator branch, wherein a first resistive element is connected between the bias node and a pick-off node coupled to provide the pick-off voltage, and a tap node is connected between the bias node and the resistive element, the regulator branch comprises the bias node, the first resistive element, the tap node, a voltage divider comprising second and third resistive elements and a fourth resistive element the voltage divider connected between the tap node and the ground, wherein the voltage divider comprises the bias node, the first resistive element is connected between the bias node and the pick-off node, the second resistive element is connected between the voltage divider and the ground node, and the tap node is connected between the bias node and the first resistive element, the first, second, third, and fourth resistive elements have resistances R_met, R1, R2, and R2_met, respectively, and the ratio R1_met/R2 met is equal to the ratio R1/R2;

drawing a tap current from a current mirror connected to the tap node, the tap current having a component that is proportional to a load current of the load so that the pick-off voltage increases when the load current increases and decreases when the load current decreases.

13. The method of claim 12, wherein the tap current is equal to a fraction 1/K of the load current, wherein K is a constant greater than five.

14. The method of claim 13, wherein the first resistive element has a resistance R1_met and the one or more connecting lines together have a resistance Rwire, and wherein R1_met divided by K is approximately equal to Rwire.

15. The method of claim 12, wherein the first resistive element-and the one or more connecting lines are made of the same material.

16. The method of claim 12, wherein the first resistive element and the one or more connecting lines are made of a metal.

17. The method of claim 12, comprising regulating the bias voltage to a reference voltage using a feedback network.

18. The method of claim 17, wherein the feedback network comprises an operational amplifier and a transistor; the operational amplifier has a reference input, a feedback input and an amplifier output; the transistor is connected between a supply node and the pick-off node and has a control terminal connected to the amplifier output.

* * * * *